United States Patent [19]

Fehrer

[11] 4,070,811

[45] Jan. 31, 1978

[54] MACHINE FOR SPINNING TEXTILE FIBERS

[76] Inventor: Ernst Fehrer, Auf der Gugl 28, Linz, Austria

[21] Appl. No.: 722,750

[22] Filed: Sept. 13, 1976

Related U.S. Application Data

[63] Continuation-in-part of Ser. No. 602,546, Aug. 7, 1975, abandoned.

[30] Foreign Application Priority Data

Sept. 24, 1974 Austria ..... 7694/74

[51] Int. Cl.[2] ..... D01G 15/68

[52] U.S. Cl. ..... 57/50; 19/105; 19/150

[58] Field of Search ..... 19/105, 150, 157, 83, 19/96; 57/56, 58.89, 58.95, 156, 50

[56] References Cited

U.S. PATENT DOCUMENTS

| | | | |
|---|---|---|---|
| 1,355,518 | 10/1920 | Osten | 19/83 |
| 1,425,920 | 8/1922 | Osten | 19/83 |
| 3,029,477 | 4/1962 | Wildbolz et al. | 19/105 X |
| 3,635,006 | 1/1972 | Fehrer | 19/157 X |
| 3,826,071 | 7/1974 | Grau | 57/58.95 X |

*Primary Examiner*—Dorsey Newton

*Attorney, Agent, or Firm*—Kurt Kelman

[57] ABSTRACT

A machine for spinning textile fibers comprises a carding drum with a toothed surface which generates a cylinder during rotation, a mechanism for feeding a roving or sliver of the textile fibers to the carding drum for disintegration thereon and a spinning station arranged to receive the disintegrated fibers from the carding drum and for spinning them. The feeding mechanism comprises a pair of nip rollers in surface contact, each nip roller having an elastic surface layer, a smooth-surfaced large diameter feed roller close to the nip rollers and spaced as closely as possible from the cylinder defined by the toothed surface of the carding drum, the smooth roller surface and the cylinder defining a triangular space therebetween, and a small diameter feed roller in the triangular space and in contact with the smooth surface, the smaller diameter roller having an elastic surface layer and preceding the larger diameter roller in the direction of rotation of the carding drum. A guard is closely spaced from the large diameter feed roller and extends arcuately therefrom in the direction of rotation around part of the cylinder. The guard is spaced from the cylinder as closely as possible and the roving or sliver is disintegrated between the toothed surface of the carding drum and the guard.

2 Claims, 1 Drawing Figure

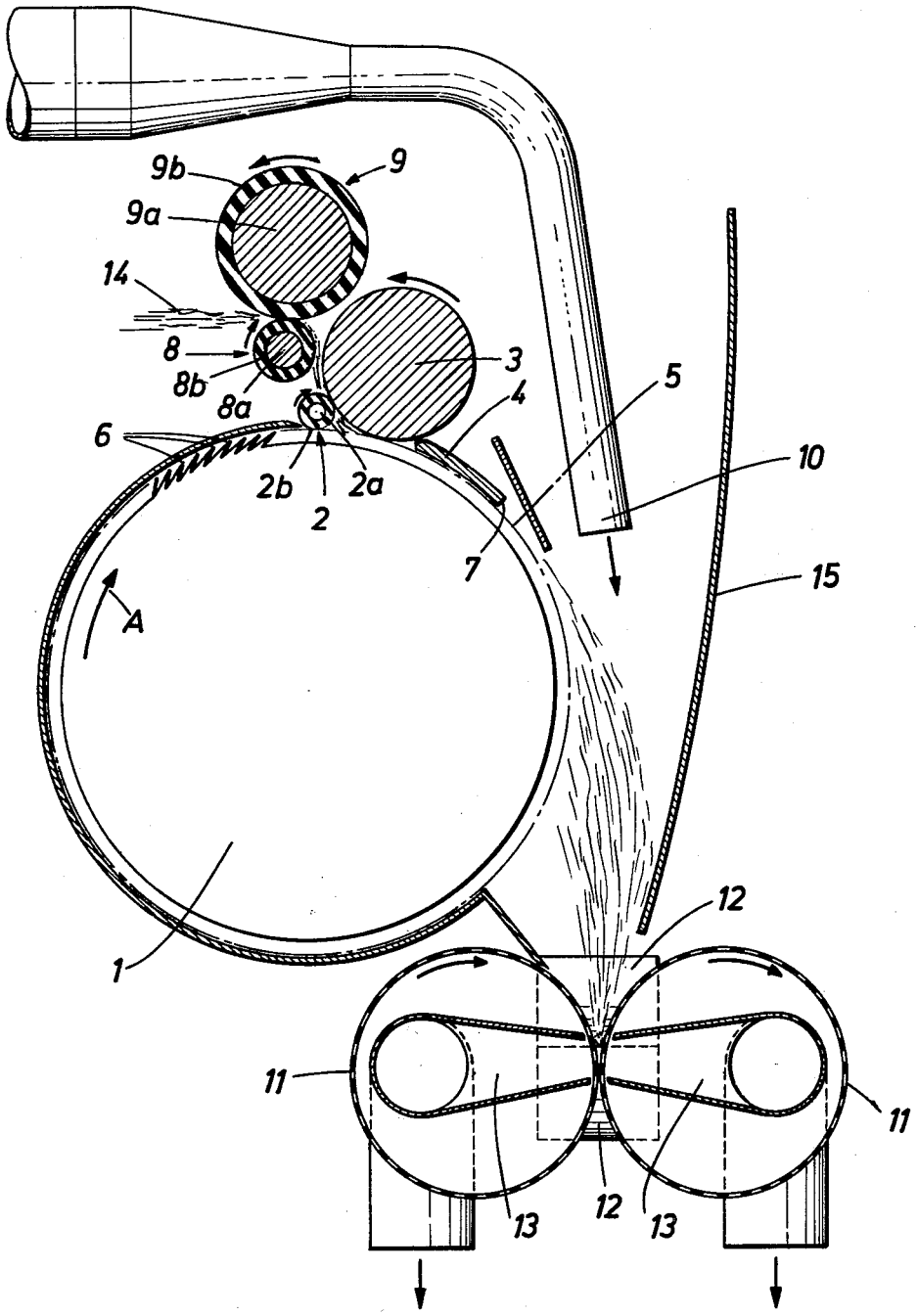
9b
9
9a
14
8
8b
8a
3
4
5
6
2b
2a
2
10
7
15
A
1
12
11
11
13
12
13

MACHINE FOR SPINNING TEXTILE FIBERS

This is a continuation-in-part application of my copending application Ser. No. 602,546, filed Aug. 7, 1975, now abandoned.

The present invention relates to a machine for spinning textile fibers, which comprises a carding drum rotatable at high circumferential speed in a predetermined direction and having teeth with tips defining a cylindrical surface during rotation of the carding drum, a mechanism for feeding a roving or sliver of the textile fibers to the carding drum for disintegrating the roving or sliver into the textile fibers on the rotating toothed surfaces of the drum, and a spinning station arranged to receive the disintegrated textile fibers from the carding drum and for spinning the textile fibers. The feeding mechanism comprises a pair of nip-forming feed rollers of unequal diameter, the larger one of the feed rollers having a smooth surface.

The roving or sliver being fed is gripped between the nip-forming feed rollers so that it can be combed out by the teeth of the rotating carding drum. German Patent No. 428,427 discloses a feeding mechanism which comprises two feed rollers which differ in size. The larger feed rollers has a surface which may be smooth and the triangular space between the two feed rollers and the carding drum is occupied by a trough table. The carding drum rotates in a direction which may cause the fibers drawn over the top edge of the table to be damaged. This is of no importance in the apparatus of the patent because its object is not to ensure uniform disintegration of a roving or sliver into undamaged fibers but the separation of impurities of higher specific gravity from the fibers, the separated impurities falling into a downwardly diverging space between the trough table and the carding drum.

It is an object of this invention to eliminate the disadvantages of prior art machines of this general type and to ensure uniform disintegration of a roving or sliver into its constituent textile fibers without damaging the fibers even at a high throughput rate.

This and other objects are accomplished according to the invention in a spinning machine of the indicated type with a feeding mechanism comprising a pair of gripping rollers in surface contact to define a nip therebetween for feeding the roving or sliver therethrough, the rollers having axes at a fixed distance from each other whereby the surface contact is maintained, each gripping roller having a hard core and an elastic surface layer wherebetween the roving or sliver is gripped, and the gripping rollers being rotatable at a circumferential speed lower than that of the carding drum, a large diameter feed roller close to the pair of gripping rollers and having a smooth surface receiving the roving or sliver from the pair of gripping rollers, the smooth surface of the larger diameter feed roller being spaced from the cylindrical surface defined by the teeth of the carding drum as closely as possible, and the smooth roller surface and the cylindrical surface defining therebetween a wedge-shaped space, and a small diameter feed roller arranged in the wedge-shaped space and in contact with the smooth surface of the larger diameter feed roller to define a nip therebetween for feeding the roving or sliver received on the smooth surface therethrough, the feed rollers having axes at a fixed distance from each other whereby the contact is maintained, the small diameter feed roller consisting of a hard core and an elastic surface layer, and the small diameter feed roller preceding the large diameter feed roller in the direction of rotation of the carding drum, the feed rollers being rotatable at a circumferential speed intermediate that of the gripping rollers and of the carding drum. A guard is closely spaced from the large diameter feed roller and extends arcuately from the large diameter feed roller in the direction of rotation around part of the cylindrical surface. The guard is spaced from the cylindrical surface as closely as possible and the roving or sliver is disintegrated into the textile fibers between the toothed surface of the carding drum and the guard.

In accordance with a preferred feature of the present invention, the path from the nip between the feed rollers to the trailing end of the guard has a length corresponding to the maximum length of the fibers. In this manner, the fibers are released from the nip before they reach the trailing end of the guard, which contributes to the uniformity of the disintegration.

The above and other objects, advantages and features of this invention will become more apparent from the following detailed description of a now preferred embodiment thereof, taken in conjunction with the single FIGURE of the accompanying drawing which diagrammatically shows a sectional view of the spinning machine.

The illustrated machine for spinning textile fibers comprises carding drum 1 rotatable at high circumferential speed, i.e., from 2000 rpm to 4200 rpm, in a predetermined direction indicated by arrow A, the carding drum having teeth 6 with tips defining cylinder 5 during rotation of the carding drum.

A mechanism for feeding roving or sliver 14 of textile fibers to carding drum 1 for disintegrating the roving or sliver into its constituent textile fibers on the rotating toothed surface of the drum comprises a pair of gripping rollers 8, 9 in surface contact to define a nip therebetween for feeding the roving or sliver therethrough. The rollers have axes at a fixed distance from each other whereby the surface contact is maintained, i.e., rollers 8 and 9 are mounted unyieldingly with respect to each other. The gripping rollers each have a respective hard core *8a, 9a* and an elastic surface layer *8b, 9b,* for instance of rubber, wherebetween the roving or sliver 14 is gripped. The gripping rollers are rotatable at a circumferential speed lower than that of the carding drum, i.e., the inlet speed of rollers 8, 9 may be steplessly adjusted to 0 – 5.2 m/min, the usual speed of feeding the roving through the gripping rollers being about 1–3 m/min, with the speed of succeeding rollers 2, 3 being 20% higher.

The feeding mechanism further comprises large diameter feed roller 3 cooperating with small diameter feed roller 2. While the ratio of the diameters of rollers 2 and 3 is not critical, the diameter of roller 3 is a multiple of that of roller 2, a useful diameter ratio being, for instance, 1 : 3 to 1 : 5, such as 1 : 4. Large diameter roller 3 is disposed close to the pair of gripping rollers 8, 9. The gripping rollers, closely spaced to and preceding the feed roller, improve the feeding or roving or sliver 14. It consists, for example, of steel and has a smooth, unbroken surface receiving roving or sliver 14 from the gripping rollers. The smooth surface of feed roller 3 is spaced from cylindrical surface 5 defined by teeth 6 of carding drum 1 as closely as possible, and the smooth roller surface and the cylindrical surface define therebetween a wedge-shaped space. Feed roller 2 is arranged in the wedge-shaped space and is in contact with the smooth surface of the large diameter feed roller to define a nip therebetween for feeding the roving or sliver received on the smooth surface therethrough. The large and small diameter feed rollers have axes at a fixed distance from each other whereby the contact is maintained unyieldingly.

The purpose of making the diameter of roller 2 substantially smaller than that of roller 3 and of arranging roller 2 in the wedge-shaped space between the smooth surface of roller 3 and cylindrical ruled surface 5 is to make the space between the feed rollers and carding drum 1 as small as possible. Only such a small space for feeding roving or sliver 14 to the carding drum assures a trouble-free transfer of the tips of the constituent fibers of the roving or sliver from the nip between rollers 2 and 3 to the path of carding drum teeth 6 underneath roller 3, the trouble-free fiber transfer being of decisive importance in the uniform disintegration of the roving or sliver into its individual constituent fibers to be fed to the spinning station for spinning into yarns.

Small diameter feed roller 2 consists of hard core 2*a* and elastic surface layer 2*b*, for instance of rubber, and precedes large diameter feed roller 3 in the direction of rotation of carding drum 1. The feed rollers are rotatable at a circumferential speed intermediate that of the gripping rollers and of the carding drum. Since the circumferential speed increases gradually from the gripping rollers, to the feed rollers and finally the carding drum, a drawing action results.

As shown in the drawing, a guard 4 is closely spaced from large diameter feed roller 3 and extends arcuately from roller 3 in the direction of rotation around part of cylindrical ruled surface 5. The guard is spaced from this surface as closely as possible and this can be done only because the surface of roller 3 is smooth. This feature is important because, unless the guard is very closely spaced from the large diameter feed roller, the front ends of the fibers fed to the teeth of carding drum 1 would have a tendency to be displaced upwardly by the rotating drum teeth while their rear ends are still held in the nip between feed rollers 2 and 3. Such an uncontrolled delay in the movement of the fiber tips would again cause non-uniformity in the fiber carding. The very closely spaced guard prevents such upward displacement of the fiber front ends and assures their forward movement without delay. Thus, roving or sliver 14 is disintegrated into its constituent fibers between the toothed surface of the carding drum and the guard in a uniform manner. Preferably, as pointed out hereinabove, the distance from the nip between rollers 2 and 3 and trailing end 7 of guard 4 is as long as the maximum fiber length.

Because large diameter feed roller 3 has a smooth and hard surface, the fibers cannot be radially displaced toward the axis of this roller but only against the elastic surface of roller 2, i.e., in the direction of its axis and towards the surface of carding drum 1. Since feed roller 3 and guard 4 are spaced as closely as possible from the carding drum surface, any fanning out of the fibers or formation of a beard will be precluded, thus assuring uniform disintegration. The elastically yielding surface of roller 2 ensures tight gripping of all fibers so that a premature removal of individual constituent fibers from the roving or sliver is precluded. Although the entire unit runs at very high speed, the fibers are released in a constant number per unit of time. The nip between an elastically yielding and hard, smooth surface contributes to the desired result of obtaining a uniform supply of fibers to the spinning station. Guard 4 adds to this result by maintaining the fibers in contact with the carding drum until the rear ends of the fibers have been released from the nip between rollers 2 and 3. This result is obtained for all fibers if the guard has the same length as the maximum fiber length. Without guard 4 very close to the tips of carding drum teeth 6, the fibers would be radially outwardly displaced out of contact with the teeth, thus reducing the carding effect. The close spacing of guard 4 to the tips of the carding drum teeth assures that the fibers remain within the reach of the teeth for effective carding.

The fibers are fed from carding drum 1 to a spinning station of any suitable structure. The illustrated spinning station is that disclosed in my U.S. Pat. No. 3,913,310, dated Oct. 21, 1975, whose entire disclosure is herein incorporated by reference.

To facilitate the delivery of the disintegrated fibers to the spinning station through a feed path defined between carding drum 1 and a baffle 15, nozzle 10 is arranged to blow air into the feeding path so that the fibers are airborne to the throat between closely spaced, parallel suction drums 11, 11. Each suction drum has a suction insert 13 which define a suction zone adjacent the throat. The two suction drums rotate in the same sense, as indicated by arrows. The fibers impinge on the suction zone in a stream which is approximately perpendicular to the plane defined by the axes of the suction drums and are twisted together as a result of the rotation of the drums to form a yarn. A pair of draw-off rolls 12, 12 draws off the spun yarn or thread parallel to drums 11, 11. As indicated, the spinning station is known per se and any suitable spinning device may be used in the combination which constitutes the present invention.

What is claimed is:

1. A machine for spinning textile fibers, which comprises the combination of 1. a carding drum rotatable at high circumferential speed in a predetermined direction, the carding drum having
   a. teeth with tips defining a cylindrical surface during rotation of the carding drum:
2. a mechanism for feeding a strand of the textile fibers to the carding drum disintegrating the strand into the textile fibers on the rotating toothed surface of the drum, the feeding mechanism comprising
   a. a pair of gripping rollers in surface contact to define a nip therebetween for feeding the strand therethrough, the rollers having axes at a fixed distance from each other whereby the surface contact is maintained, each of the gripping rollers having a hard core and an elastic surface layer wherebetween the strand is gripped, and the gripping rollers being rotatable at a circumferential speed lower than that of the carding drum, b. a large diameter feed roller close to the pair of gripping rollers and having a smooth surface receiving the strand from the pair of gripping rollers, the smooth surface of the large diameter feed roller being spaced from the cylindrical surface defined by the teeth of the carding drum as closely as possible, and the smooth roller surface and the cylindrical surface defining therebetween a wedge-shaped space, and c. a small diameter feed roller arranged in the wedge-shaped space and in contact with the smooth surface of the large diameter feed roller to define a nip therebetween for feeding the strand received on the smooth surface therethrough, the feed rollers having axes at a fixed distance from each other whereby the contact is maintained, the small diameter feed roller consisting of a hard core and an elastic surface layer, and the small diameter feed roller preceding the large diameter feed roller in the direction of rotation of the carding drum, and being spaced from the cylindrical surface defined by the teeth, of the carding drum as closely as possible the feed rollers being rotatable at a circumferential speed intermediate that of the gripping rollers and of the carding drum;

3. a guard closely and fixedly spaced from the large diameter feed roller in the direction of rotation around part of the cylindrical surface, the guard being spaced from the cylindrical surface as closely as possible, the strand being disintegrated into the textile fibers between the toothed surface of the carding drum and the guard;

4. a spinning station arranged to receive the disintegrated textile fibers from the carding drum and for spinning the textile fibers; and 5. means for transporting the disintegrated textile fibers from the carding drum to the spinning station.

2. The spinning machine of claim 1, wherein the guard has a trailing end and the path from the nip between the feed rollers to the trailing end has a length corresponding to the maximum length of the fibers.

* * * * *